US010770043B1

(12) United States Patent
Edwards

(10) Patent No.: US 10,770,043 B1
(45) Date of Patent: Sep. 8, 2020

(54) TUBULAR THUNDER STICKS

(71) Applicant: Michael Edwards, Austin, MN (US)

(72) Inventor: Michael Edwards, Austin, MN (US)

( * ) Notice: Subject to any disclaimer, the term of this patent is extended or adjusted under 35 U.S.C. 154(b) by 0 days.

(21) Appl. No.: 16/594,938

(22) Filed: Oct. 7, 2019

(51) Int. Cl.

| | |
|---|---|
| ***G10D 13/12*** | (2020.01) |
| ***F21V 33/00*** | (2006.01) |
| ***F21V 23/02*** | (2006.01) |
| ***F21V 23/04*** | (2006.01) |
| ***F21V 17/12*** | (2006.01) |
| ***F21V 15/01*** | (2006.01) |
| *F21Y 115/10* | (2016.01) |

(52) U.S. Cl.
CPC ..... *G10D 13/12* (2020.02); *F21V 15/01* (2013.01); *F21V 17/12* (2013.01); *F21V 23/02* (2013.01); *F21V 23/04* (2013.01); *F21V 23/0471* (2013.01); *F21V 33/0056* (2013.01); *F21Y 2115/10* (2016.08)

(58) Field of Classification Search
CPC ..... G10D 13/12
See application file for complete search history.

(56) References Cited

U.S. PATENT DOCUMENTS 4,106,079 A 8/1978 Drury
4,226,163 A * 10/1980 Welcomer ..... G10D 13/12 84/422.4
4,722,035 A * 1/1988 Rapisarda ..... G10D 13/12 362/109
5,350,881 A * 9/1994 Kashio ..... G10H 1/34 84/622
6,423,891 B1 * 7/2002 Zengerle ..... G10D 13/12 84/422.4
6,479,737 B1 11/2002 Lebeda
9,035,160 B2 * 5/2015 Rapp ..... G10H 7/00 84/104
9,123,268 B2 * 9/2015 Uehara ..... G10H 1/053
9,430,997 B2 * 8/2016 Hardi ..... G10H 1/18
9,773,480 B2 * 9/2017 Rapp ..... G10D 13/12
10,311,849 B2 * 6/2019 Hardi ..... G10H 1/0033
2009/0019986 A1 * 1/2009 Simpkins, III ..... G10D 13/12 84/422.4
2011/0017046 A1 * 1/2011 Stockli ..... G10D 13/12 84/422.4
2011/0030533 A1 * 2/2011 Piccionelli ..... G10H 1/0083 84/422.4
2020/0058275 A1 * 2/2020 Gunn ..... G10D 13/12

* cited by examiner

*Primary Examiner* — Robert W Horn
(74) *Attorney, Agent, or Firm* — Vidas Arrett & Steinkraus P.A.

(57) ABSTRACT

A wireless drumstick having a tubular hollow body portion, having a tip section having a plurality of LED lights mounted inside the tip section, at least a portion of the tip section being translucent to allow the LED light to illuminate the tip of the drumstick. The tubular hollow body portion further including a wireless mic, and a battery is electronically connected to the LED lights and wireless mic.

6 Claims, 2 Drawing Sheets

NOTE: DRUMSTICKS CAN BE MADE OF ALUMINUM (AS SHOWN) OR OF A CLEAR PLASTIC ALLOWING COLOR LED LIGHT TO SHINE THROUGH THE ENTIRE STICK.

TUBULAR THUNDER STICKS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The invention relates to wireless mic drumsticks with very small LED lights placed into the stick body when they are manufactured.

US 2009/0019986 A1, published Jan. 22, 2009 discloses a drumstick with integrated microphone.

U.S. Pat. No. 4,226,163, issued Oct. 7, 1980 discloses illuminated drumsticks.

U.S. Pat. No. 4,106,079, issued Aug. 8, 1978 discloses illuminated drum stick.

U.S. Pat. No. 6,479,737, issued Nov. 12, 2002 discloses a system and method for emitting laser light from a drumstick.

U.S. Pat. No. 4,722,035, issued Jan. 26, 1988 discloses a drumstick with light emitting diode.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

When a drum or cymbal is hit there is no delay in the sound, as with a miced drum set, and the lights flash simultaneously with the sound. Alternatively, the LED lights could be configured to strobe or be always on. The wireless technology can be any available technology, like Bluetooth or WIFI or even cellular.

DETAILED DESCRIPTION OF THE INVENTION

Figure 1:
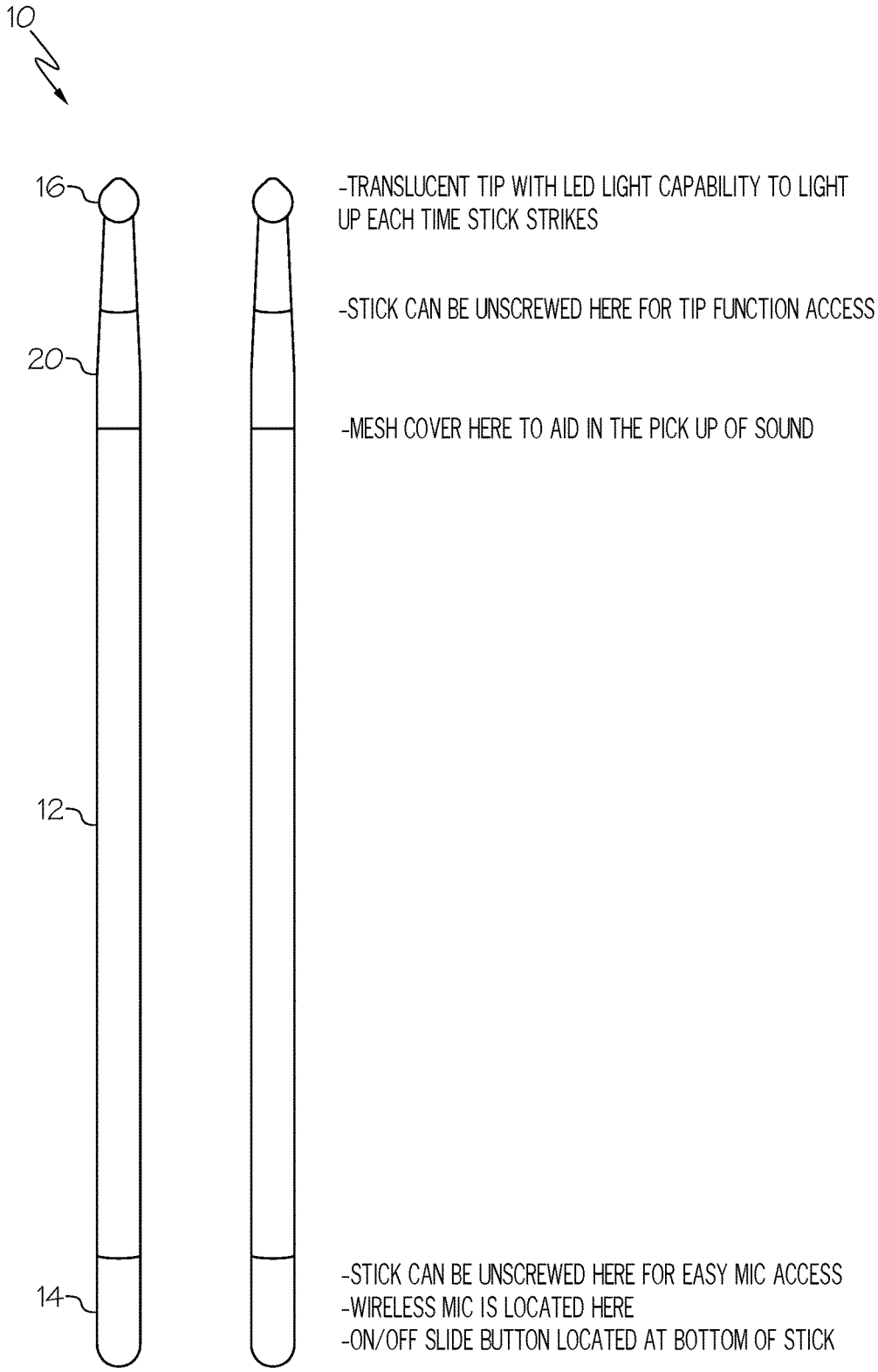
FIG. 1 shows a view of a pair of inventive drumsticks.

Referring now to FIG. 1, a two section version of the wireless drumstick is shown generally at 10. The drumstick has a body section 12 and a butt end section 14, which screw together. The body section includes a translucent tip 16 and a mesh section 20 which cover the LED lights (not shown) and which help carry the sound to the wireless mic (not shown). The on/off switch is located on the bottom of the drumstick.

Figure 2:
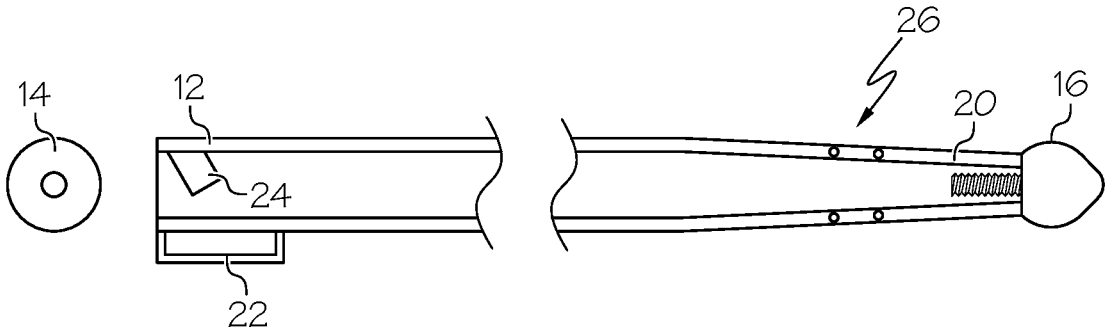
FIG. 2 shows a schematic cross-sectional view of a two part embodiment of the inventive drumstick.

Referring now to FIG. 2, a cross-section view of a two part drumstick embodiment is shown, in which the body section is shown at 12 and the butt end section is shown at 14. The two parts are designed to screw together screw together and electrically connect the LED's and wireless mic to the battery. The battery 22 can either be carried by the butt section 14 or the body section 12, and can be carried inside the drumstick of be connected to the outside of the drumstick. Alternatively, a battery pack could be connected to the drumstick by conductive wire and the battery pack could be carried on the body of the drummer, or placed under the seat the drummer sits on. A wireless mic 24 picks up the sound transmitted to it and wireless transmits it to a sound system (not shown). A plurality of LED lights are connected to the inside of body 12 at 26, and covered by a light metal mesh section 20, which both protect the LED lights and also help carry the sound to the wireless mic 24. The drumstick has a translucent tip 16 which is illuminated by the LED lights. The drumsticks can either be made of a metal such as aluminum, with the translucent tip allowing light out, or a clear plastic which allows the entire drumstick to illuminate.

Figure 3:
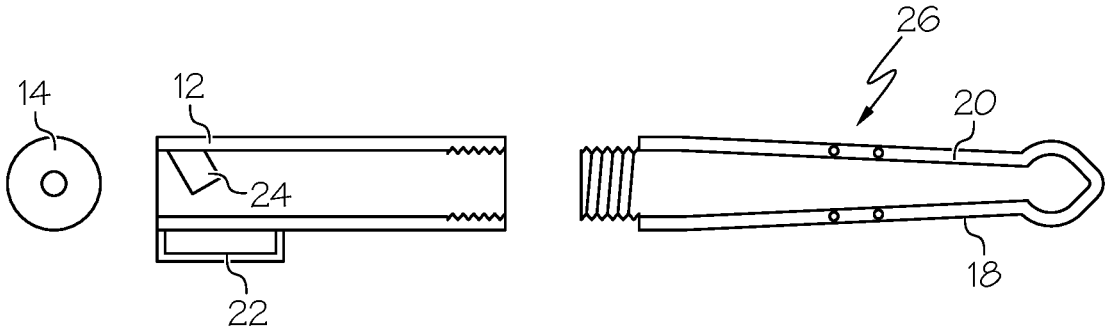
FIG. 3 shows a schematic cross-sectional view of a three part embodiment of the inventive drumstick.

Referring now to FIG. 3, a cross-section view of a three part drumstick embodiment is shown, in which the body section is shown at 12 and the butt end section is shown at 14 and a LED light tip section is shown at 18. The three parts are designed to screw together and electrically connect the LED's and wireless mic to the battery. The battery 22 can either be carried by the butt section 14 or the body section 12, and can be carried inside the drumstick of be connected to the outside of the drumstick. Alternatively, a battery pack could be connected to the drumstick by conductive wire and the battery pack could be carried on the body of the drummer, or placed under the seat the drummer sits on. A wireless mic 24 picks up the sound transmitted to it and wireless transmits it to a sound system (not shown). A plurality of LED lights are connected to the inside of body 12 at 26, and covered by a light metal mesh section 20, which both protect the LED lights and also help carry the sound to the wireless mic 24. The drumstick has a translucent tip 16 which is illuminated by the LED lights.

The drumstick can be any commercially available size, for example the ⅝ inch outer diameter and 7/16 inch inner diameter size. A ½ inch outer diameter tube could also be used. The drumstick can be manufactured with a since body section with a screw on tip. Alternatively, there could be a main body section, a light section and a tip section, which could all screw together. The body section or main body section would hold the battery and wireless communication electronics, as well as the control electronics for controlling the selected lighting effect. An on/off switch could be at the butt end of the drumstick, as well as a selector switch to select the light on impact, strobe or always on lighting mode. Electrical connections for the lights and wireless mic are made when the sections are screwed together, to connect the lights and wireless mic to the battery. The drumsticks can be made of a metal, such as aluminum with a translucent tip to allow the LED light to illuminate the tip, or be made of a clear plastic to allow the color LED lights to illuminate the entire stick.

The modular nature of the drumsticks allows for ease of replacing the wireless mic portion, or the electronic control portion, as well as replacing the battery, without having to replace the entire drumstick.

The drumstick can be played with a drum, but could also be used with a computer or smart TV.

The drumsticks could be lighted by impact or by sound activation.

The light metal mesh both protects the LED lights and helps carry the sound to the wireless mic, which is at the butt end of the drum stick.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A wireless drumstick comprising:

a tubular hollow body portion, having a tip section having a plurality of LED lights mounted inside the tip section, at least a portion of the tip section being translucent to allow the LED light to illuminate the tip of the drumstick;

the tubular hollow body portion further including a wireless mic, and a battery is electronically connected to the LED lights and wireless mic.

2. The wireless drumstick of claim 1 wherein the drumstick is made of two sections which screw together.

3. The wireless drumstick of claim 1 wherein the drumstick is made of three sections which screw together.

4. The wireless drumstick of claim 1 further including a mesh covering attached to the tip section, to protect the LED lights and carry the sound inside the drumstick to the wireless mic.

5. The wireless drumstick of claim 1 further including control electronics connected to a power switch carried by the butt end of the drumstick, and further connected to a selector switch for selecting a mode selected from the group consisting of light on impact, light on sound activation, strobe light and always on light.

6. The wireless drumstick of claim 1 wherein the battery is outside the drumstick body, either to be attached to a drummer or under a seat the drummer sits on, and is electrically connected to the drumstick with a wire.

* * * * *